United States Patent [19]

McMullen et al.

[11] 3,957,509

[45] May 18, 1976

[54] METHOD AND APPARATUS FOR REMOVING CONTAMINANTS FROM AN ELECTROSTATIC IMAGING SURFACE

[75] Inventors: Thomas B. McMullen, Webster; Robert L. Maness, Macedon, both of N.Y.

[73] Assignee: Xerox Corporation, Stamford, Conn.

[22] Filed: Apr. 30, 1974

[21] Appl. No.: 465,719

[52] U.S. Cl. ..... 96/1 R; 15/256.52; 134/9; 355/15; 355/17

[51] Int. Cl.[2] ..... G03G 13/22; G03G 15/22

[58] Field of Search ..... 355/15, 17; 15/1.5, 15/256.52; 134/6, 9; 96/1 R

[56] References Cited

UNITED STATES PATENTS

| | | | |
|---|---|---|---|
| 3,682,689 | 8/1972 | Dueltgen et al. | 134/6 X |
| 3,770,429 | 11/1973 | Kinoshita et al. | 96/1 R |
| 3,807,853 | 4/1974 | Hudson | 355/15 |

OTHER PUBLICATIONS

Crooks; W., I.B.M. Technical Disclosure Bulletin, "Cleaning of Reusable Photoconductive Insulators," May 1970, Vol. 12, No. 12, p. 2285.

*Primary Examiner*—Fred L. Braun

*Attorney, Agent, or Firm*—Paul Weinstein; Clarence A. Green; James J. Ralabate

[57] ABSTRACT

An apparatus and process are provided for removing contaminants from the surface of an electrostatic imaging member. The apparatus includes elements for cleaning the surface to remove toner particles and other particulate materials therefrom, and elements for removing the contaminants from the surface after it has been cleaned by the cleaning elements. The contaminant removal elements comprise at least one brush which moves relative to the surface wherein the brush exerts a normal force per unit fiber against the surface of at least two milligrams. A reproducing apparatus and process are also provided.

14 Claims, 4 Drawing Figures

METHOD AND APPARATUS FOR REMOVING CONTAMINANTS FROM AN ELECTROSTATIC IMAGING SURFACE

CROSS REFERENCE TO RELATED APPLICATION

U.S. application Ser. No. 471,524, filed May 20, 1974 to Thettu et al, for an Improved Cleaning System.

BACKGROUND OF THE INVENTION

This invention relates to an apparatus and process for removing film-like contamination from the surface of an electrostatic imaging member. The invention is particularly adapted for use in a xerographic reproducing machine.

In some xerographic reproducing machines film type contamination on the surface of the photoconductive plate has been found to cause deletions in the image on the copy sheet. These deletions are believed to occur due to lateral surface conduction in the contaminant film which has the effect of discharging portions of the electrostatic image on the photoconductive plate. Those portions of the image which have been so discharged then show up as deletions in the resulting copy sheet. The film material is believed to be made up principally of organic components including toner degradation products and other species as well as one or more inorganic elements or compounds. These film type contaminants are believed to be derived from environmental sources, both internal and external of the machine. Contamination films of this type have been found to be resistant to conventional xerographic plate cleaning procedures such as the use of a resilient cleaning blade.

Various procedures for removing residual toner particles and other types of particulate components from the surface of an electrostatic imaging member are known, as for example, the use of resilient blades, brushes, webs, or the like. Numerous systems have been proposed wherein more than one cleaning element is provided in order to have redundancy in the cleaning system. Thereby, if the first cleaning element fails or incompletely removes toner particles, the second cleaning element will remove those remaining particles. For example, U.S. Pat. No. 3,552,850, granted Jan. 5, 1971, to Royka et al. discloses the use of multiple cleaning blades. In U.S. Pat. No. 3,795,025, the use of multiple brushes as a cleaning system is disclosed. In German Offenlegungsschrift, 2,111,509, laid open for public inspection Sept. 23, 1971, there is disclosed a redundant cleaning system comprising a blade which removes the predominant portion of any residual toner particles and a cleaning roller following the blade for removing any remaining particles. The surface of the roller is covered with a coating of woven or knitted cloth, suede or the like. It is alleged that the wiper and the roller operate according to different principles so that their disadvantages are balanced and complete cleaning can be achieved. It is not known whether these redundant cleaning systems would be effective to remove contaminant films of the type described above.

In addition to the foregoing prior art, there is provided in U.S. Pat. No. 3,664,300, granted May 23, 1972, to Joseph, a system for applying lubricants to the surface of an electrostatic imaging member. In accordance with one embodiment thereof, a bar brush applicator is employed. The lubricant applicator may be located in the imaging cycle following a cleaning system or as described and shown it may act in a dual fashion as the basic cleaning system.

SUMMARY OF THE INVENTION

In accordance with this invention an apparatus and process are provided including a cleaning means for removing toner particles and other particulate type contaminants. A contaminant removing means is provided positioned between the cleaning means and the means for charging the electrostatic imaging member. The contaminant removing means is adapted to remove film type contaminants particularly contaminants as described above which would otherwise cause deletions in the resulting copy sheet. The contaminant removing means comprises at least one brush which is substantially more abrasive than brushes conventionally used in xerography for removing toner particles and the like. The brush fibers are selected to provide a normal force per unit fiber against the surface of the electrostatic imaging member of at least two miligrams and preferably at least four miligrams. Preferably the brush is rotated at a peripheral speed of from about 0.1 to about 1.5 feet per second.

Therefore, it is an object of this invention to provide an apparatus for removing contaminant films from the surface of an electrostatic imaging member.

It is a further object of this invention to provide a reproducing apparatus including the above-noted apparatus.

It is a further object of this invention to provide a process for removing contaminant films from the surface of an electrostatic imaging member.

These and other objects will become more apparent from the following description and drawings.

DETAILED DESCRIPTION OF THE PREFERRED EMBODIMENTS

Figure 1:
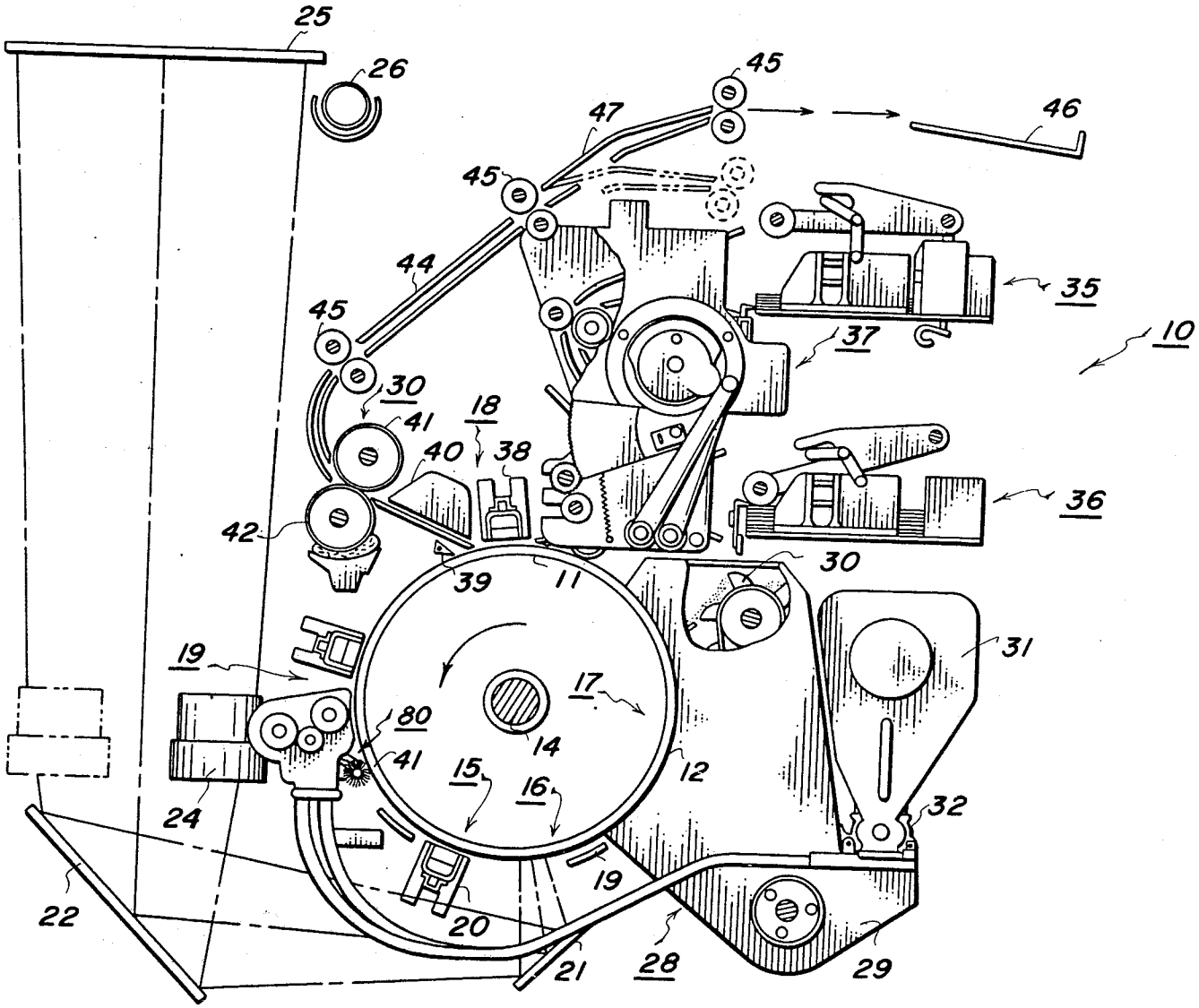
FIG. 1 is a schematic view of an exemplary xerographic type copying machine incorporating the improved contamination removal apparatus of the present invention.

Referring to the drawings, there is shown, for purposes of explanation, a xerographic type copying machine, designated generally by the numeral 10, incorporating the improved cleaning apparatus of the present invention. Copying machine 10 has a drum-like part 11, the exterior surface 12 of which is finished with a suitable electrostatic imaging or photoconductive material in a manner known to those skilled in the art. Drum 11, which is suitably journaled by means of shaft 14, rotates in the direction indicated by the solid line arrow of FIG. 1 to bring the photoconductive surface 12 thereof past a plurality of xerographic processing stations as will appear more fully herein. Suitable drive means are provided to drive the various operating components of copying machine 10.

While a cylindrical or drum shaped photoconductive part 11 has been shown herein, other configurations, such as a flat plate, belt, or the like may be contemplated.

The xerographic processing stations of copying machine 10 include a charging station 15, wherein an electrostatic charge is deposited on the photoconductive surface 12 preparatory to imaging; an exposure station 16 where a light radiation transmitted image of the document being copied is projected onto the photoconductive surface 12 to form a latent electrostatic image; a developing station 17 where a suitable xerographic developing material including ink or toner particles is cascaded onto the drum surface 12 to develop the latent electrostatic image on the drum surface; a transfer station 18 where the toner defined image is electrostatically transferred from the surface 12 of drum 11 to another surface, normally the copy sheet; and a drum cleaning and toner collecting station 19 where the surface of drum 11 is cleaned in preparation for reuse thereof.

Charging station 15 includes a suitable corona generator 20, the discharge electrode or electrodes of which extend in spaced relation transversely across the drum surface in a direction generally parallel to the axis of drum 11. A suitable source of electrical energy is provided for corona generator 20 together with suitable shielding means to direct the charge emitted therefrom toward the drum surface.

Exposure station 16, which is downstream of charging station 15, has an image mirror 21 arranged opposite the surface 12 of drum 11 and adapted, via object mirror 22 and movable lens 24, to transmit an image of the document being copied onto the photoconductive surface 12 of the rotating drum 11 as the surface 12 moves therepast. The document being copied is supported by a transparent platen 25, a suitable illuminating device such as lamp 26 being provided to illuminate the document during the copying process. Lens 24, which is optically positioned below platen 25, moves along a path generally parallel to platen 25 in timed relation to rotation of drum 11.

Figure 2:
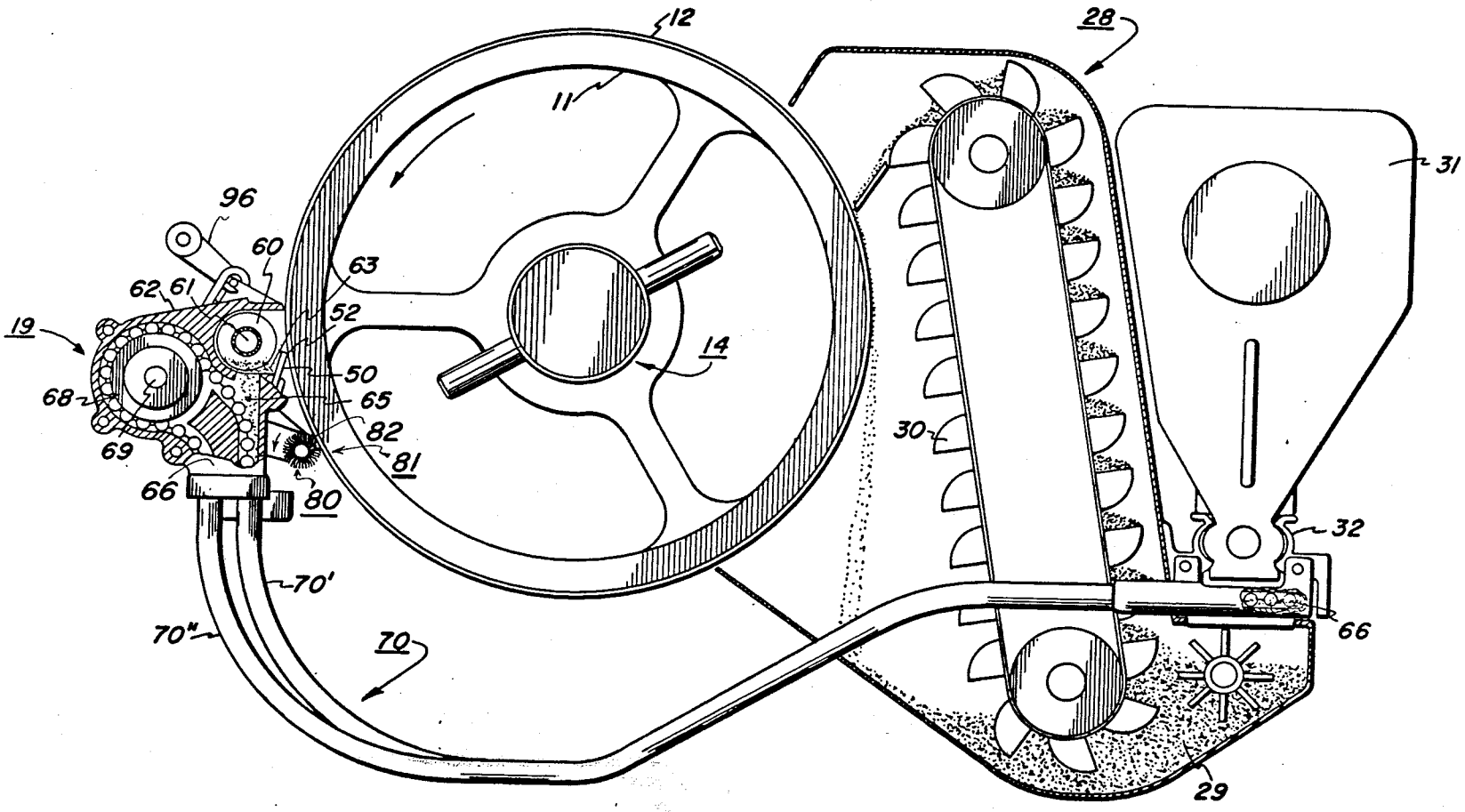
FIG. 2 is an enlarged side view with parts broken away showing details of the copying machine cleaning apparatus.

Developing station 17 is downstream of exposure station 16 and as best seen in FIG. 2, includes a developer housing 28, the leading edge of which is complementary to drum 11. The portion of housing 28 forms a sump 29 within which a quantity of xerographic developing material is stored. A bucket type conveyor 30 is provided for bringing the developing material from the sump 29 to the drum surface 12, conveyor 30 serving at the discharge point thereof to cascade the developing material downwardly onto the upwardly moving photoconductive surface 12 of drum 11. As will be understood by those skilled in the art, the toner particles deposited onto the drum surface are electrostatically attracted thereto in a pattern complementary to the charge pattern on the photoconductive surface 12 to develop the xerographic image. Unused developing material falls back into the sump 29. Toner is suppled to sump 29 from plastic supply bottle 31 through an automatic dispensing apparatus 32. In addition, and as will appear more fully, toner removed from drum 11 at the toner cleaning and recovery station 19 is returned to sump 29.

Referring again to FIG. 1, image transfer station 18 is downstream of developer station 17. There, individual copy sheets drawn from either upper feed tray 35 or lower feed tray 36 are brought, by sheet feeding mechanism 37, into transfer relationship with the surface 12 of drum 11 where the developed image is electrostatically transferred from drum 11 to the copy sheet by means of transfer corotron 38 in a manner known to those skilled in the art. A stripper finger 39, operatively supported adjacent the surface 12 of drum 11 downstream of corotron 38, serves to remove or strip the copy sheet from drum 11 and onto vacuum transport 40. Transport 40 carries the image bearing copy sheet forward into the nip formed by fuser roll pair 41, 42. There a combination of heat and pressure functions to fix the toner image on the copy sheet as the sheet moves through the rotating fuser roll pair 41, 42 and into the sheet return track 44. Return track 44 includes pinch rolls 45 to carry the copy sheet to output tray 46.

A movable guide mechanism 47 is provided to allow the copy sheet to be alternatively routed into the upper feed tray 35. From there, the copy sheet can be run back through the copying machine 10 to image the reverse side thereof following which the new image is fixed and the finished copy sheet having images on both sides discharged into output tray 46.

The drum cleaning and toner recovery station 19, which is downstream of the transfer station 18 and upstream of the charging station 15 serves to clean residual toner and from the surface of drum 11 following image transfer. The removed toner is returned to sump 29 of developer housing 28 for reuse.

Figure 3:
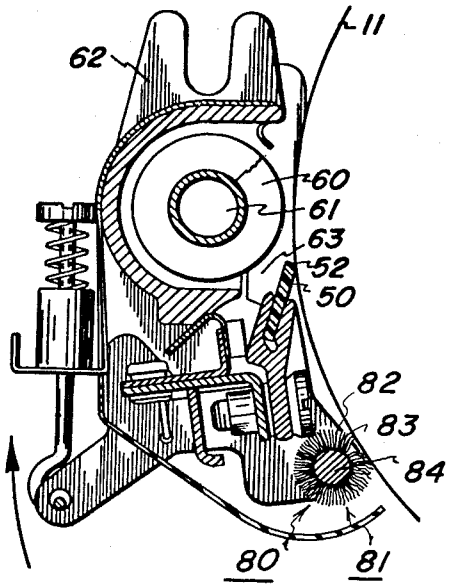
FIG. 3 is a cross-sectional view showing details of the apparatus of the present invention.
Figure 4:
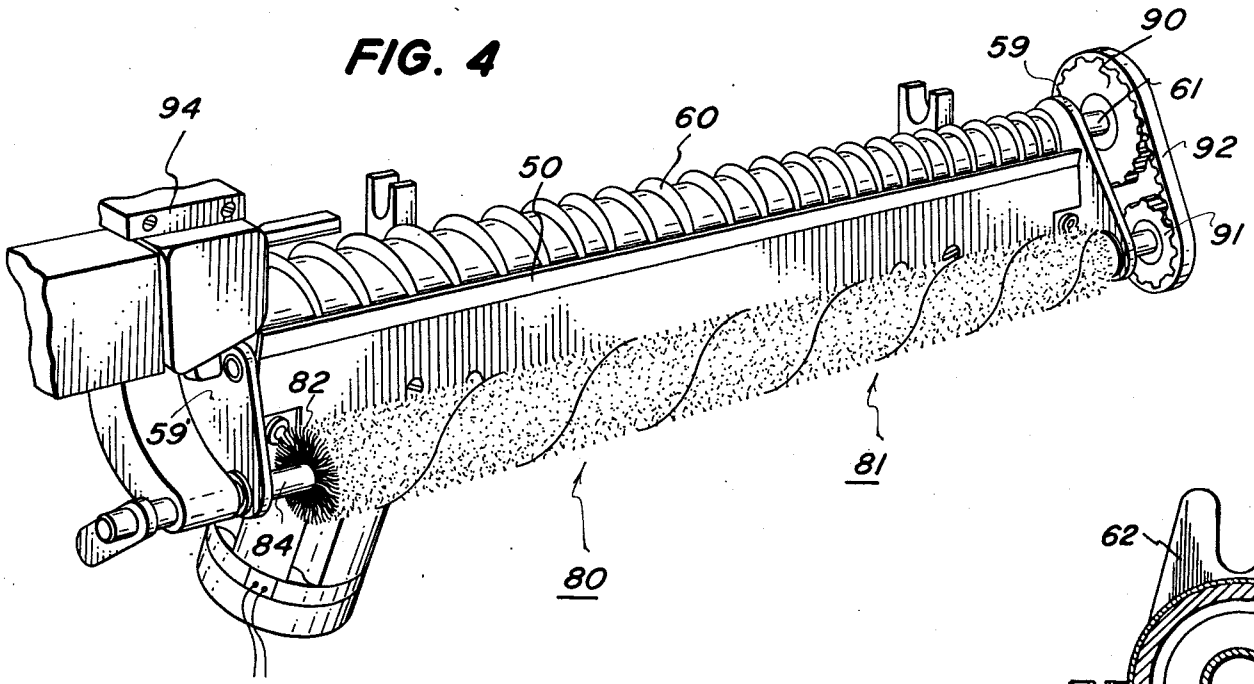
FIG. 4 is a partial perspective view of the apparatus of the present invention.

Referring particularly to FIGS. 2–4, toner cleaning and recovery station 19 includes a relatively soft, flexible cleaning blade 50. Blade 50, which as will appear, oscillates back and forth across drum 11 during cleaning, has a leading edge 52 in contact with drum surface 12. Since the normal imaging or working width of drum surface 12 is somewhat less than the overall width of drum 11, the effective length of blade 50 is preferably equal to the working width of drum surface 12 plus an amount equal to the stroke of blade movement to assure effective cleaning of the entire working width of drum 11. Blade 50 is preferably positioned so that edge 52 thereof extends toward drum 11 in a direction opposite to the direction in which drum 11 rotates so that blade angle between blade 50 and the plane tangent to drum 11 at the line of contact of the blade edge 52 with drum surface 12 is selected for optimum cleaning or scraping effect.

Blade 50 is comprised of any suitable flexible material, for example, polyurethane. Preferably, the blade material used should be relatively soft to prevent or minimize abrasion, scouring, scratching, etc., of the photoconductive surface 12 by the blade, yet allow effective cleaning of the surface 12.

To return toner removed from drum 11 to developer sump 29, there is provided a transfer auger 60. Auger 60 is carried on shaft 61 journaled in end caps 59, 59′ of toner recovery housing 62.

The lower portion of toner recovery housing 62, together with blade 50, cooperate to form a channel-like recess 63 behind blade 50 into which toner removed by blade 50 deposits. Auger 60, which is operatively disposed within housing 62 adjacent recess 63 conveys toner accumulating in recess 63 laterally along recess 63 to inlet 65 of toner conduit 70. There, bead chain conveyor 66 carries the toner through leg 70′ of toner conduit 70 to developer sump 29.

A gear-like drive sprocket 68 is provided for bead chain conveyor 66, sprocket 68 being supported by stub shaft 69 rotatably journaled in end cap 59′ of toner recovery housing 62. Stub shaft 69 is conveniently driven from auger shaft 61 through suitable gearing means.

Leg 70' of toner conduit 70 leads from toner recovery housing 62 to sump 29 of developer housing 28, suitable openings 71 being provided in conduit 70 opposite sump 29 to enable the toner to be discharged therefrom. Toner conduit leg 70'' leads back to the housing 62 to complete the toner recovery loop. As will be understood, the relative interior and exterior dimensions of toner conduit 70 and conveyor 66 are chosen to assure effective conveying of toner from recovery housing 62 through conduit 70 to developer sump 29.

To enhance the cleaning efficiency of blade 50, and avoid or at least reduce localized wear on the blade wiping edge 52 and trapping of toner or other foreign material between blade 50 and the drum surface 12, the blade 50 is slowly moved ot oscillated back and forth across the drum surface whenever drum 11 is turning and up to a limited duration thereafter as will appear.

The apparatus just described includes the preferred toner cleaning system 19, however, it is believed that the contamination cleaning apparatus 80 of this invention can be used in conjunction with other types of conventional toner cleaning systems.

The contamination cleaning apparatus 80 comprises at least one brush 81. The brush is positioned between the toner cleaning system 19 and the charging station 20. The brush 81 is significantly different in character than brushes of the type conventionally employed for cleaning toner particles from xerographic plates. The principal characteristic by which it differs from those conventional brushes is its greater degree of abrasiveness. In order to remove the aforenoted contamination films a more abrasive brush element 81 having an increased normal force per unit fiber is required.

The term "normal force per unit fiber" as the term is used herein is defined as the normal force exerted by the brush against the imaging member divided by the number of fibers in the area of contact between the brush and the imaging member. It may be measured by conventional techniques. For example, a load measuring surface is positioned in place of the imaging surface. A load measuring transducer measures the force exerted by the brush against the surface. The area of contact between the brush and the surface is measured. The measured area is then multiplied by the number of fibers per unit area of the brush to obtain the number of fibers in the area of contact. Then following the above-noted calculation, the normal force per unit fiber may be determined. It should be apparent that the calculated force comprises an average fiber force and some fibers may exert a greater or lesser force. The force per unit fiber is related to the abrasiveness of the brush. The greater this force is the more abrasive is the brush.

In accordance with this invention the brush includes a plurality of fibers 82 which are selected to provide a force per unit fiber normal to the surface of the electrostatic imaging member 12 of at least two miligrams and preferably at least four miligrams. The upper limit for the force per unit fiber may be selected as desired depending on the abrasion resistance of the imaging member. The amount of force used herein is believed to be in the neighborhood of an order of magnitude greater than the force per unit fiber of conventional xerographic toner cleaning brushes. For example, the force per unit fiber for one commercially used brush was found to be about 0.3 mg.

The use of fibers 82 to provide this degree of abrasiveness is permissible in accordance with this invention since the rotational speed of the brush may be significantly less than that employed for conventional toner removing brushes. In accordance with this invention a rotational speed of from about 50 to about 500 revolutions per minute and a peripheral brush speed of from about 0.1 to about 1.5 feet per second should be adequate to accomplish removal of the contaminant films. This compares with brush speeds for toner removing brushes generally in the neighborhood of 1,000 to 2,000 RPM and with peripheral brush speeds in the neighborhood of 9 to 30 feet per second.

Other parameters which have a bearing on the force per unit fiber exerted by the brush include; the fiber length or pile height; the pile density or number of fibers per unit area; the fiber denier; and the brush to imaging surface interference. Generally as these parameters increase the force per unit fiber increases.

Preferably, in accordance with this invention, the pile height of the brush is from about 0.05 to about 0.25 inches. This is relatively shorter than the pile heights of conventional toner cleaning brushes. Preferably the brushes have from about 25,000 to about 100,000 fibers per square inch and the brush to imaging surface interferences are from about 0.05 to about 0.25 inches. Brush fibers in the range of 5 to 15 denier may be selected to provide the desired unit normal force.

A suitable material for providing the fibers in accordance with the present invention has been found to be mohair. It is not necessary, however, in accordance with this invention that all of the fibers in the brush have the same abrasiveness. The brush may be formed of any desired type of fiber or mixtures of fibers. One brush constructed in accordance with this invention was comprised of a mixture of 50 percent mohair fibers and 50 percent Dynel (nylon) fibers. An alternative brush in accordance with this invention was constructed entirely of mohair fibers.

The brush diameter preferably is from about ½ inch to about 2 inches in order to provide a compact arrangement.

In U.S. Pat. Nos. 2,832,977, granted May 6, 1968, to Walkup et al; and 3,682,689, granted Aug. 8, 1972, to Dueltgen et al, there are disclosed a number of suitable toner cleaning brush fiber materials which may also be useful in accordance with this invention if the other brush parameters are selected to give the appropriate force per unit fiber. The use of mohair in a belt-type brush is disclosed in U.S. Pat. No. 3,781,107 granted Dec. 25, 1973, to Ruhland.

It should be apparent from a consideration of the parameters of the prior art toner type cleaning brushes as compared to the parameters of the contamination removal brush of the invention that the two types of brushes are readily distinguishable. In fact, it can be stated that the contamination removal brush of this invention would not be adequately effective as a toner removing device. While it would undoubtedly remove some of the toner should toner be present on the imaging surface, it would not be operative to remove enough of it to be an operative cleaning system for that purpose. Further, operating a brush having characteristics in accordance with this invention at speeds in accordance with prior art toner cleaning devices would result in excessive abrasion of the imaging members surface. Therefore, the present means 80 for removing film type contaminants does not represent a redundant cleaning system such as those suggested by the patents cited in the background of this invention, but rather it represents a system for a purpose entirely different from the purpose of the conventional toner removal system.

Having thus described a suitable brush for use in the contamination removal means 80 of this invention the specific apparatus of FIGS. 1 to 4 will now be described in greater detail.

The contamination removal means 80 of this invention is positioned between the cleaning station 19 and the charging station 20. In the apparatus shown the brush 81 is supported within the cleaning housing 62 downstream of the blade 50. The brush 81 comprises a cylindrical core 83 with the fibers 82 extending outwardly therefrom about the circumference of the core. Preferably the brush fabric is helically wrapped about the core 83. The brush core is affixed to a shaft 84 which is rotatably supported in end plates 59 and 59'. The brush 81 is preferably rotated in a direction counter to the direction of the drum 11.

In the embodiment shown, a sprocket wheel 90 connected to the auger shaft 61 drives a sprocket wheel 91 connected to the brush supporting shaft 84 by means of belt 92. The auger 60 itself is driven by any suitable means, as for example it may be gear driven at 94 from a motor (not shown).

The cleaning housing 62 is pivotably supported against the drum surface 12 by means of a pivot arm 96 as shown in FIG. 2. This provides a means for adjusting the position of the brush 81 relative to the drum surface. After the brush has been biased against the surface 12 the desired amount the pivot arm 96 is locked in place by any suitable means (not shown). The bias force of the blade against the drum may be adjusted independently of the housing by means of the mechanism shown in FIG. 3 which is described in greater detail in U.S. Pat. No. 3,724,019 granted Apr. 3, 1973 to Shanly.

It is apparent from the foregoing description that no provision has been made in the apparatus shown for removing contaminants or other matter from the contaminant removal brush 81 of this invention. It is believed that the contaminants remain in the brush which can then be periodically replaced to provide a fresh contaminant removal device. The use of a flicker bar is not desired in the absence of a vacuum system for carrying away contaminants removed from the brush. If a flicker bar were employed without a vacuum system the contaminants could float around in the housing and redeposit upon the imaging surface.

It is possible in accordance with this invention to utilize a brush without the necessity for a flicker bar and vacuum removal system since the cleaning means 19 which comprises the blade 50 is effective to remove substantially all of the residual particles such as toner from the drum surface which might otherwise print out on the copy sheet. If this were not the case it is clear that the brush would load up very quickly and lose its effectiveness as a contaminant removal device.

The omission of a vacuum system is advantageous since it reduces machine noise and power requirements. Therefore, the ability to employ a brush without a vacuum cleaning system represents a significant advantage of this invention. It should be apparent, however, that if desired, a system for removing contaminants from the brush could be employed without departing from the present invention. The system shown and described herein represents an extremely compact arrangement which has the further advantage of being easily retrofittable into commercial apparatuses by virtue of its compact nature.

The process of this invention comprises providing an electrostatic imaging surface. The imaging surface is cleaned to remove residual toner and particulate contaminants such as dust. Following the cleaning step film-like contaminants are removed by brushing while exerting a normal force per unit fiber of at least 2 mg and preferably at least 4 mg.

Preferably the process comprises a reproducing process including the following additional steps:

forming a latent electrostatic image on said surface;

developing the latent electrostatic image to provide a visible powder image; and transferring the powder image to a sheet of final support material.

These steps are then followed by the previous cleaning and contaminant removal steps. The process may be carried out automatically by sequentiaally repeating these steps to produce a desired number of copies.

Preferably the reproducing process comprises a xerographic process including the further steps of exposing an original document to provide an optical image thereof and projecting the image upon the electrostatic imaging member. The exposure step takes place between the charging and the developing steps.

The aforenoted processes are preferably carried out by an apparatus as previously described; therefore, in the step of removing film-like contaminants the brush is preferably moved relative to the imaging surface at a peripheral speed of from about 0.1 to about 1.5 feed per second.

It should be apparent from the foregoing that while the invention has been described with respect to an apparatus in process for use in a xerographic type reproducing machine, it is equally applicable to other types of reproducing machines, such as, for example, electrostatic printers.

The patents specifically referred to in this application are intended to be incorporated by reference into the application.

It is apparent that there has been provided in accordance with this invention, a contamination removal device and process which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a reproducing process including the steps of forming a latent electrostatic image on a moving electrostatic imaging surface; developing said latent electrostatic image to provide a visibl powder image; and transferring the powder image to a sheet of final support material; the improvement wherein these steps are followed by the steps of cleaning said imaging surface to remove residual toner particles and other particulate materials therefrom; and following said cleaning step removing contaminants from said surface by brushing said surface with a rotating brush while applying a normal force per unit fiber of the brush against said surface of at least 2 milligrams said brush being rotated at a peripheral speed of from about 0.1 to about 1.5 feet per second.

2. In a reproducing process including the steps of forming an electrostatic image on a moving electrostatic imaging surface; developing said electrostatic image with toner particles to provide a visible image; transferring the visible image to a sheet of final support material; and cleaning said imaging surface to remove residual toner particles therefrom; the improvement wherein:

following said cleaning step contaminants are removed from said surface by rotating a brush against said surface while applying a normal force per unit fiber of the brush against said surface of at least 2 milligrams, said brush comprising a cylindrical brush which is rotated at a peripheral speed of from about 0.1 to about 1.5 feet per second, and further wherein said brush has a pile height of from about 0.05 to about 0.25 inches, wherein the interference between said brush and said surface is selected in the range of from about 0.05 to about 0.25 inches, wherein the density of fibers in said brush is selected within the range of from about 25,000 fibers per square inch to about 100,000 fibers per square inch and wherein the denier of fibers in said brush is selected from about 5 to about 15.

3. A process as in claim 2, wherein said force per unit fiber comprises at least 4 milligrams.

4. A process in claim 3, wherein said brush is between ½ to 2 inches in diameter and wherein said brush is rotated at a speed of from 50 to 500 revolutions per minute.

5. A process as in claim 4, wherein said brush is pivotably supported against said surface.

6. A process as in claim 5, wherein said forming step comprises charging said imaging surface; and exposing an original document to provide an optical image thereof and projecting the image upon said electrostatic imaging surface.

7. An apparatus for removing contaminants from the surface of an electrostatic imaging member comprising:

means for cleaning said surface to remove substantially all toner particles therefrom, said cleaning means comprising at least one resilient blade engaging said surface; and means for removing contaminants from said surface after it has been cleaned by said blade, said contaminant removal means comprising at least one cylindrical brush which rotates at a peripheral speed of from about 0.1 to about 1.5 feet per second, said brush exerting a normal force per unit fiber against said surface of at least 2 milligrams, said brush having a pile height selected within the range of from about 0.05 to about 0.025 inches, the interference between said brush and said surface being selected in the range of from about 0.05 to about 0.25 inches, the density of fibers in said brush being selected within the range of from about 25,000 fibers per square inch to about 100,000 fibers per square inch, and the denier of fibers in said brush being selected from about 5to about 15.

8. An apparatus as in claim 7, wherein said brush is between ½ to 2 inches in diameter and wherein said brush is rotated at a speed of from 50 to 500 revolutions per minute.

9. An apparatus as in claim 7, wherein said force per unit fiber comprises at least 4 milligrams.

10. An apparatus as in claim 9, wherein said brush is pivotably supported against said surface.

11. In a reproducing apparatus including a member having an imaging surface, means for forming an electrostatic image on said surface, means for developing said image with toner particles to render it visible, means for transferring said developed image to a sheet of final support material, and means for cleaning said imaging surface to remove substantially all of the residual toner particles therefrom, the improvement wherein said apparatus further includes;

means positioned between said cleaning means and said image forming means for removing film-like contaminants from said imaging surface, said contaminant removing means comprising at least one cylindrical brush which rotates at a periheral speed of from about 0.1 to about 1.5 feet per second, said brush exerting a normal force per unit fiber against said surface of at least 2 milligrams, said brush having a pile height selected within the range of from about 0.05 to about 0.25 inches, the interference between said brush and said surface being selected in the range from about 0.05 to about 0.25 inches, the density of fibers in said brush being selected within the range of from about 25,000 fibers per square inch to about 100,000 fibers per square inch, and the denier of fibers in said brush being selected from about 5 to about 15.

12. An apparatus as in claim 11, wherein said force per unit fiber comprises at least 4 milligrams.

13. An apparatus as in claim 12, wherein said brush is between ½ to 2 inches in diameter and wherein said brush is rotated at a speed of from 50 to 500 revolutions per minute.

14. An apparatus as in claim 13, wherein said brush is pivotably supported against said surface.

* * * * *